US006276860B1

(12) United States Patent
Nakajima et al.

(10) Patent No.: US 6,276,860 B1
(45) Date of Patent: Aug. 21, 2001

(54) LIQUID APPLICATOR

(75) Inventors: Nobuyuki Nakajima, Takasaki; Kenzi Sato, Maebashi; Shigeki Ohba, Fujioka, all of (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/605,336

(22) Filed: Jun. 27, 2000

(30) Foreign Application Priority Data

Jun. 29, 1999 (JP) ..... 11-182976
Aug. 26, 1999 (JP) ..... 11-239471
Aug. 26, 1999 (JP) ..... 11-239472

(51) Int. Cl.[7] ..... B43K 8/08
(52) U.S. Cl. ..... 401/199; 401/205; 401/207
(58) Field of Search ..... 401/198, 199, 401/196, 205, 206, 207, 223, 224, 241, 227, 229

(56) References Cited

U.S. PATENT DOCUMENTS 4,712,937 * 12/1987 Schmidt et al. ..... 401/199 X
5,096,322 * 3/1992 Shiga et al. ..... 401/199
5,352,051 * 10/1994 Tamura et al. ..... 401/198 X
5,951,187 * 9/1999 Hsieh ..... 401/199

FOREIGN PATENT DOCUMENTS 2-81666 6/1990 (JP) .
6-45776 6/1994 (JP) .

* cited by examiner

*Primary Examiner*—Gregory L. Huson
*Assistant Examiner*—Kathleen J. Prunner
(74) *Attorney, Agent, or Firm*—Darby & Darby

(57) ABSTRACT

A liquid applicator has a vaned collector. The collector's rear end is abutted on a partition having a concave portion, creating a gap B therebetween. A cylindrical projection is formed inside the rear sleeve concentrically on its axis so that a replaceable cartridge holding ink is removably attached with its front end fitted to the cylindrical projection. A trunk core's rear end is inserted into a communication passage that is formed in the cylindrical projection with a gap A formed between the trunk core surface and the wall surface of the communication passage. This gap A is put in communication with an ink slit of the collector via gap B. Grooves are formed in the convex portion while a number of ribs are formed apart with respect to a barrel's circumference on inner peripheral surface of the communication passage of the cylindrical projection. These ribs stably support the rear end of the trunk core. Gap A between the rear end of the trunk core and the inner peripheral surface of the communication passage of the cylindrical projection should fall within the following range: 0.02 mm≦A≦0.25 mm, and the ink should be of a water-based ink having a viscosity of 12 mPa.s or below at 25° C. Gap A, gap B, slit width C and spacing D are specified so that A≦B≦C≦D. This setting assures smooth flow of the application liquid such as ink etc., with respect to the cartridge.

6 Claims, 6 Drawing Sheets

LIQUID APPLICATOR

BACKGROUND OF THE INVENTION (1) Field of the Invention

The present invention relates to a liquid applicator, including writing implements such as felt pens and cosmetic applicators such as eyebrow applicators etc., and more detailedly relates to a liquid applicator of a replaceable cartridge type which enables stable ink supply to a pen core thereof.

(2) Description of the Prior Art

Conventionally, as a writing implement that is a typical applicator, a felt pen using a replaceable ink cartridge is disclosed in Japanese Utility Model Application Laid-Open Hei 6 No.45776.

A cartridge replaceable writing implement of this type comprises, as shown in FIG. 1, a barrel body 100 composed of a front barrel 101 and a rear barrel 102 separably screw-fitted to front barrel 101. This front barrel 101 is sectioned by a partition 103 into a front sleeve 104 and a rear sleeve 105.

A cylindrical projection 106 is formed inside rear sleeve 105 of front barrel 101, concentrically on its axis. A replaceable cartridge 400 holding ink W is removably attached so that its front end is fitted to this cylindrical projection 106. That is, the front end is tightly sealed by a sealing ball 402 in cooperation with a sealing ball seat 401 at the front end of cartridge 400 and when the sealing of this sealing ball 402 is released, ink W inside cartridge 400 is introduced to a communication passage 107 of cylindrical projection 106.

Provided at the front end of front sleeve 104 of front barrel 101 is a sealing sleeve 108, through which a collector 200 is inserted into front sleeve 104. This collector 200 is retained loosely or with a gap with respect to an inner peripheral surface 104a of front sleeve 104 so as to allow air communication with the atmosphere. Formed in this collector is an axial communication passage 201 that is in contact with and in communication with communication passage 107 of cylindrical projection 106.

A plastic mouthpiece (holder) 200a is formed on the front side of collector 200 so that a pen core 202 is inserted into and held by the front end portion of communication passage 201. The rear end face, designated at 200b, of collector 200 is abutted on partition 103 inside front barrel 101. A trunk core 203 is provided with its front end 203a inserted into communication passage 201 and joined to pen core 202 while its rear end 203b is extended to and loosely fitted to communication passage 107 of cylindrical projection 106 formed on the rear sleeve 105 side of front barrel 101 with a gap A created with respect to the inner periphery of communication passage 107. With this arrangement, ink W stored in cartridge 400 is introduced to the communication passage 201 side of collector 200 via communication passage 107 of cylindrical projection 106 and permeates trunk core 203 to be supplied to the pen core 202 side.

Formed further on the outer peripheral portion of collector 200 is an ink collecting portion 300, which is composed of a multiple number of collector vanes 301 arranged comb-like in the axial direction with intervals of a desired spacing D. An ink slit 302 allowed to communicate with the atmosphere is formed extending in the axial direction across all collector vanes 301. The open end, designated at 302a of this ink slit 302, on the collector rear end face 200b side, is adapted to communicate with communication passage 107 of cylindrical projection 106 through a gap B.

That is, this gap B establishes communication between ink slit 302 formed in the outer peripheral portion of collector 200 and communication passage 107 of cylindrical projection 106, so that variation in pressure inside cartridge 400 due to temperature rise from, for example, body temperature of the hand holding barrel body 100 during writing, is relieved by temporarily retaining excessive ink W overflowing from such internal pressure variation, thus preventing ink W from overflowing from the front end side of front sleeve 104.

Conventional writing implements with no replaceable ink storage portion (cartridge) are classified into two types as an ink conduit from the ink storage portion: a configuration in which the collector's center slit is extended radially inward so as to reach the trunk core inside the bore (which will be called the first type: Japanese Patent Application Laid-Open Hei 2 No.81666, for example); and another configuration in which the center slit, instead of being in contact with the trunk core, is extended to the collector's rear end and is brought thereat in direct contact with ink (which will be called the second type).

In the first type, despite the fact that the trunk core is in direct contact with the center slit, since the trunk core, presenting stronger capillary attraction than the center slit, is brought in contact with the gap of the center slit, the ink is unlikely to move smoothly to the center slit in response to the pressure rise due to a temperature rise inside the ink storage portion, revealing inefficiency of the temporal ink storing function of the collector.

For the writing implements with no replaceable ink storage portion, the full range of collector's performance can be obtained by providing the center slit of the second type. In contrast, in a writing implement with a replaceable ink storage portion (replaceable cartridge), the diameter of the cylindrical portion to which the cartridge is fitted is limited (because the diameter of the mouth is limited so that the diameter of the writing implement will not become too large), so that it has been impossible to directly join the cartridge to the ink slit opening at the collector's rear end.

However, for the applicators, i.e., felt pens having the above configuration, open end 302a of ink slit 302, opening on the rear end face 200b of collector 200 is put in communication with communication passage 107 of cylindrical projection 106, an abutment face 103a of partition 103 inside front barrel 101, or the abutment face that rear end face 200b of collector 200 abuts, is formed with a stepped, concave portion 109, so as to create a gap B between abutment face 103a of partition 103 and rear end face 200b of collector 200, correspondingly to open end 302a of ink slit 302, for establishment of communication. However, when front barrel 101 is resin molded using a die elongation and/or sink due to contraction of partition 103 that sections front sleeve 104 and rear sleeve 105 tend to occur, so that the dimensions of gap B on the rear end face 200b side of collector 200 tend to vary.

Gap B formed on the rear end face 200b side of collector 200 should be formed with a predetermined dimensional accuracy so that ink W introduced from cartridge 400 by way of communication passage 107 of cylindrical projection 106 to ink slit 302 of ink collecting portion 300 will be smoothly introduced and flow by the capillary attraction to ink slit 302. Therefore, if the size of gap B varies as stated above, it is impossible to provide a stable, smooth ink channel to ink slit 302. Particularly in the case where the ink channel is narrowed and blocked, it becomes difficult to supply ink to collector 200 so ink directly passes through trunk core 203 being excessively supplied to pen core 202, which in turn spews ink when the pressure inside cartridge 400 rises due to a temperature rise.

Further, since rear end 203b of trunk core 203 being inserted to the rear sleeve 105 of front barrel 101 should be loosely placed with gap A with respect to the wall surface of communication passage 107 of cylindrical projection 106, when the dimensions of trunk core 203 unbearably deviate from the predetermined, design values, or when trunk core 203 is deformed during assembly by some external force and assembled as is, gap A between the wall surface of communication passage 107 of cylindrical projection 106 and the outer periphery of trunk core 203 varies with respect to the circumferential direction, making it difficult to provide stable ink supply to ink slit 302.

In a writing implement of the type where the ink slit of the collector is in direct contact with the ink flowing out from the ink storage portion (cartridge), the dimensions of the ink slit are of importance for balancing the replacement of ink with air. As in the above writing implement where the cylindrical projection (106) of the front barrel is fitted to the cartridge and gap A that is in direct communication with ink is formed between the trunk core and the inner peripheral surface of the cylindrical projection, the writing performance will be determined depending upon the relationship between gap A and the physical properties, especially the viscosity of the ink.

The above gap A functions as the site for replacement of the ink from the cartridge (ink storage portion) with air inside the collector and the easiness of replacement is determined by the size of the gap.

During usual writing, ink transfers from the pen core to a medium to be written in such as paper etc., while ink from the cartridge is supplied to the pen core by way of the trunk core. The ink in the cartridge is drawn to move by the capillary attraction to the trunk core, which causes reduction in pressure inside the cartridge. This reduction in pressure is cancelled by replacing ink with air entering gap A together with ink, or the entrance of the air into the cartridge while the designed, normal amount of ink flow during writing is maintained.

However, when gap A is narrow, it becomes difficult to replace ink with air in gap A, so that the replacement will not occur unless the reduction in pressure inside the cartridge becomes extremely large. When the reduction in pressure inside the cartridge cannot be cancelled, the degree of reduction of pressure grows, inhibiting the ink inside the cartridge from being drawn out by the capillary attraction to the trunk core and hence causing tenuous line drawing and writing failures such as ink starvation. When a high-viscous ink is used, the speed of replacement of ink with air during writing becomes retarded, also causing ink starvation.

Gap A, in addition to providing the function of air replacement, creates an interface between ink and air when the pen core is directed downward, to prevent ink from dropping from the pen core during writing by the surface tension arising at that interface, thus preventing increase in ink flow amount during writing and ink leakage (forward leakage) from the pen core and stabilizing ink flow.

Since ink can be easily replaced when gap A is large, no writing defects such as ink starvation during writing will occur. However, for example, when it is evaluated whether ink leaks forwards from the pen core under the conditions wherein the pen is placed at 50° C. for 7 days with its pen tip capped and oriented downward, the surface tension of the ink decreases with temperature increase, hence the capability of gap A for retaining ink weakens, leading to ink leakage from the pen core or the forward leakage.

SUMMARY OF THE INVENTION

The present invention has been devised in view of the above problems, and it is therefore an object of the present invention to provide a liquid applicator which enables stable introduction of ink or an application liquid such as cosmetics from a cartridge to the conduit slit at the collector's rear end, allowing smooth flowing of the application liquid between the cartridge and the collector.

It is another object of the present invention to provide an applicator which provides stable liquid application performance by positively preventing ink or liquid starvation and application failures due to forward leakage of ink or an application liquid such as cosmetics.

In order to achieve the above objects, the present invention is configured as follows:

In accordance with the first aspect of the present invention, a liquid applicator for applying an application liquid includes:

a barrel body composed of a front barrel and a rear barrel separably fitted to the front barrel, the front barrel having a partition therein which sections the front barrel into a front sleeve and a rear sleeve, the wall surface on the front sleeve side of the partition inside the front barrel is formed with a stepped, concave portion, depressed in the center with respect to the peripheral part thereof;

a trunk core for allowing the application liquid to permeate therethrough and be supplied to the writing tip;

a collector composed of an application element holder with a communication passage disposed at the front end thereof for holding an application element so as to be joined to front end of the trunk core, a collector shaft continuous from the rear end of the application element holder and having a communication passage for holding the front part of the trunk core, and a multiple number of collector vanes arranged on the outer periphery of the collector shaft at intervals in the axial direction for temporarily retaining the application liquid within the spacing, the collector being inserted inside the front sleeve in a manner that allows the outer peripheral portion to communicate with the atmosphere, wherein a liquid conduit slit is formed across each of the collector vanes, and the rear end thereof is abutted against the concave portion forming a first gap with respect to the center of the concave portion while the first gap and the liquid conduit slit are communicated with each other;

a cylindrical projection formed in the rear sleeve, extending from the partition to the rear and having a communication passage so as to hold the rear end of the trunk core that extends from the communication passage of the collector; and a replaceable cartridge storing the application liquid, the front end thereof being removably mounted to the cylindrical projection, and is characterized in that the application liquid inside the cartridge is supplied to the application element by way of the trunk core while the application liquid is also temporarily retained in the spacing between the collector vanes by virtue of fluid communication of a second gap between the inner wall of the cylindrical projection and the trunk core with the collector spacing by way of the first gap and the liquid conduit slit; and the stepped concave portion on the partition is formed with a multiple number of grooves extending radially outwardly with respect to the axial center.

In accordance with the second aspect of the present invention, the liquid applicator having the above first feature is characterized in that each groove is formed so as to be equal in either width or depth to the step size of the first gap formed in the concave portion.

In accordance with the third aspect of the present invention, the liquid applicator having the above first or second feature is characterized in that a plurality of ribs are formed apart with respect to the barrel's circumference on the inner peripheral surface of the communication passage, into which the trunk core is inserted, inside the cylindrical projection in the rear sleeve of the front barrel, so that the ribs support the rear end of the trunk core keeping it at a desired distance from the inner peripheral surface of the communication passage of the cylindrical projection.

In accordance with the fourth aspect of the present invention, a liquid applicator for applying an application liquid includes:

a barrel body composed of a front barrel and a rear barrel separably fitted to the front barrel, the front barrel having a partition therein which sections the front barrel into a front sleeve and a rear sleeve, the wall surface on the front sleeve side of the partition inside the front barrel is formed with a stepped, concave portion, depressed in the center with respect to the peripheral part thereof;

a trunk core for allowing the application liquid to permeate therethrough and be supplied to the writing tip;

a collector composed of an application element holder with a communication passage disposed at the front end thereof for holding an application element so as to be joined to front end of the trunk core, a collector shaft in the center thereof, and a multiple number of collector vanes arranged on the outer periphery of the collector shaft at intervals of spacing (D) in the axial direction for temporarily retaining the application liquid introduced through the liquid conduit slit within the spacing, the collector being inserted inside the front sleeve in a manner that allows the outer peripheral portion to communication with the atmosphere, wherein a liquid conduit slit having a predetermined width (C) is formed across each of the collector vanes, and the rear end thereof is abutted against the concave portion forming a first gap (B) with respect to the center of the concave portion while the first gap and the liquid conduit slit are communicated with each other, and the collector shaft is formed with a communication passage that allows the trunk core to be inserted therein and but is not being in direct communication with the liquid conduit slit;

a cylindrical projection formed inside the rear sleeve and having a communication passage, wherein the rear end of the trunk core extending from the collector's communication passage is inserted into the cylindrical projection with a second gap (A) kept from the inner wall of the communication passage thereof; and a replaceable cartridge storing the application liquid, the front end thereof being removably mounted to the cylindrical projection, and is characterized in that the application liquid inside the cartridge is supplied to the application element by way of the trunk core while the application liquid is also temporarily retained in the spacing between the collector vanes by virtue of fluid communication of the second gap between the inner wall of the cylindrical projection and the trunk core with the collector spacing by way of the first gap and the liquid conduit slit; and the second gap (A) is specified to fall within the following range:

$$0.02\ \text{mm} \leq A \leq 0.25\ \text{mm},$$

and the application liquid is of a water-based liquid having a viscosity of 12 mPa.s or below at 25° C.

In accordance with the fifth aspect of the present invention, a liquid applicator for applying an application liquid includes:

a barrel body composed of a front barrel and a rear barrel separably fitted to the front barrel, the front barrel having a partition therein which sections the front barrel into a front sleeve and a rear sleeve, the wall surface on the front sleeve side of the partition inside the front barrel is formed with a stepped, concave portion, depressed in the center with respect to the peripheral part thereof;

a trunk core for allowing the application liquid to permeate therethrough and be supplied to the writing tip;

a collector composed of an application element holder with a communication passage disposed at the front end thereof for holding an application element so as to be joined to front end of the trunk core, a collector shaft in the center thereof, and a multiple number of collector vanes arranged on the outer periphery of the collector shaft at intervals of spacing (D) in the axial direction for temporarily retaining the application liquid introduced through the liquid conduit slit within the spacing, the collector being inserted inside the front sleeve in a manner that allows the outer peripheral portion to communication with the atmosphere, wherein a liquid conduit slit having a predetermined width (C) is formed across each of the collector vanes, and the rear end thereof is abutted against the concave portion forming a first gap (B) with respect to the center of the concave portion while the first gap and the liquid conduit slit are communicated with each other, and the collector shaft is formed with a communication passage that allows the trunk core to be inserted therein and but is not being in direct communication with the liquid conduit slit;

a cylindrical projection formed inside the rear sleeve and having a communication passage, wherein the rear end of the trunk core extending from the collector's communication passage is inserted into the cylindrical projection with a second gap (A) kept from the inner wall of the communication passage thereof; and a replaceable cartridge storing the application liquid, the front end thereof being removably mounted to the cylindrical projection, and is characterized in that the application liquid inside the cartridge is supplied to the application element by way of the trunk core while the application liquid is also temporarily retained in the spacing between the collector vanes by virtue of fluid communication of the second gap between the inner wall of the cylindrical projection and the trunk core with the collector spacing by way of the first gap and the liquid conduit slit; and the second gap (A), the first gap (B), the slit width (C) and spacing (D) are specified so as to satisfy the following relation:

$$A \leq B \leq C \leq D.$$

In accordance with the liquid applicator of the present invention thus configured as above, the abutment face of the partition inside the front barrel, which the rear end face of the collector abuts, is formed with a stepped, concave portion, so as to create the first gap between the abutment face of the partition and the rear end face of the collector, thus establishing communication between the second gap between the inner periphery of the cylindrical projection and the trunk core and the conduit slit formed in the axial direction across the collector vanes for retaining the applicator liquid. Therefore, the application liquid inside the cartridge can be temporarily retained between the collector vanes in an assured manner.

Since the stepped, concave portion formed in the partition inside the front barrel is formed with a plurality of grooves extending radially outwardly with respect to the axial center, it is possible to secure adequate application liquid channels to the liquid conduit slit even if the gap to be formed between the collector's rear end face and the abutment face of the partition becomes narrower or blocked due to elongation or sink caused by contraction during resin molding of the front barrel. This configuration allows the ink to flow easily by the capillary action of the liquid conduit slit, thus providing stable ink supply performance.

Further, since either the width or the depth of the aforementioned grooves is set equal to the gap or the size of the step formed in the stepped, concave portion, it is possible to secure adequate ink channels to the conduit slit even if the gap to be formed between the collector's rear end face and the abutment face of the partition becomes narrower or blocked. This configuration allows the ink to flow easily by the capillary action of the conduit slit, thus providing stable ink supply performance by virtue of the capillarity of the conduit slit.

Since a plurality of ribs are formed apart with respect to the barrel's circumference on the inner peripheral surface of the communication passage in the cylindrical projection on the rear sleeve side of the front barrel, to which the rear end of the trunk core is inserted so as to support the rear end of the trunk core by creating a gap from the inner peripheral surface of the communication passage of the cylindrical projection, it is thus possible to enhance the precision of the gap in all directions between the outer periphery of the trunk core and the wall surface defining the communication passage in the cylindrical projection.

In accordance with the liquid applicator of the present invention thus configured as above, the abutment face of the partition inside the front barrel, which the rear end face of the collector abuts, is formed with a stepped, concave portion, so as to create the first gap between the abutment face of the partition and the rear end face of the collector, thus establishing communication between the second gap between the inner periphery of the cylindrical projection and the trunk core and the conduit slit formed in the axial direction across the collector vanes for retaining the applicator liquid. Therefore, the application liquid inside the cartridge can be temporarily retained between the collector vanes in an assured manner.

Since second gap A is specified so that 0.02 mm$\leqq$A$\leqq$0.25 mm and the ink is specified so as to have a viscosity of 12 mPa.s or below at 25° C., it is possible to smoothly replace the ink or liquid inside the cartridge with air as the liquid is being applied and the pressure inside the cartridge becomes lowered. Therefore, the reduced pressure inside the cartridge can be cancelled smoothly. Accordingly, this feature contributes to elimination of writing or application failures such as liquid starvation during line drawing. Further, even with a water-based application liquid having a low viscosity, the setting of the second gap as above prevents forward leakage of the liquid, presenting a good result.

Further, according to the liquid applicator of the present invention, it is possible to lead ink or an application liquid for cosmetics, etc., from the cartridge to the conduit slit at the collector's rear end in a stable manner, thus enabling smooth flowing of the application liquid between the cartridge and the collector.

In the above configurations, spacing D between adjacent collector vanes may not be constant, and preferably becomes greater toward pen core 22. In this case, the smallest spacing D may and should satisfy the relationship A$\leqq$B$\leqq$C$\leqq$D. This provides assured flowing of the application liquid within the spacing between the collector vanes into or from the liquid conduit slit.

DESCRIPTION OF THE PREFERRED EMBODIMENTS

The embodiment of the present invention will hereinafter be described in detail with reference to FIGS. 2 through 8.

Figure 1:
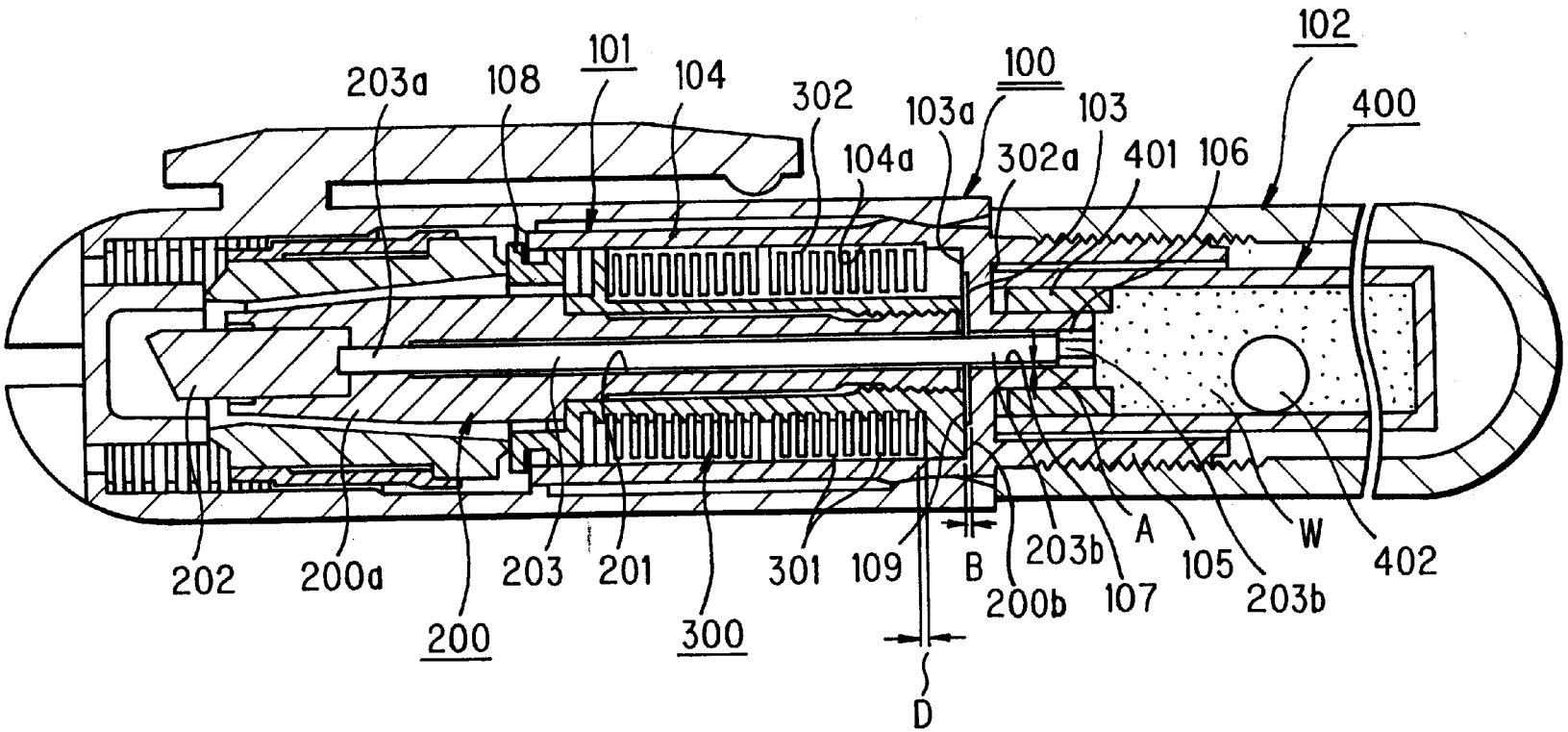
FIG. 1 PRIOR ART
FIG. 1 is a sectional view showing an example of a conventional felt pen.
Figure 2:
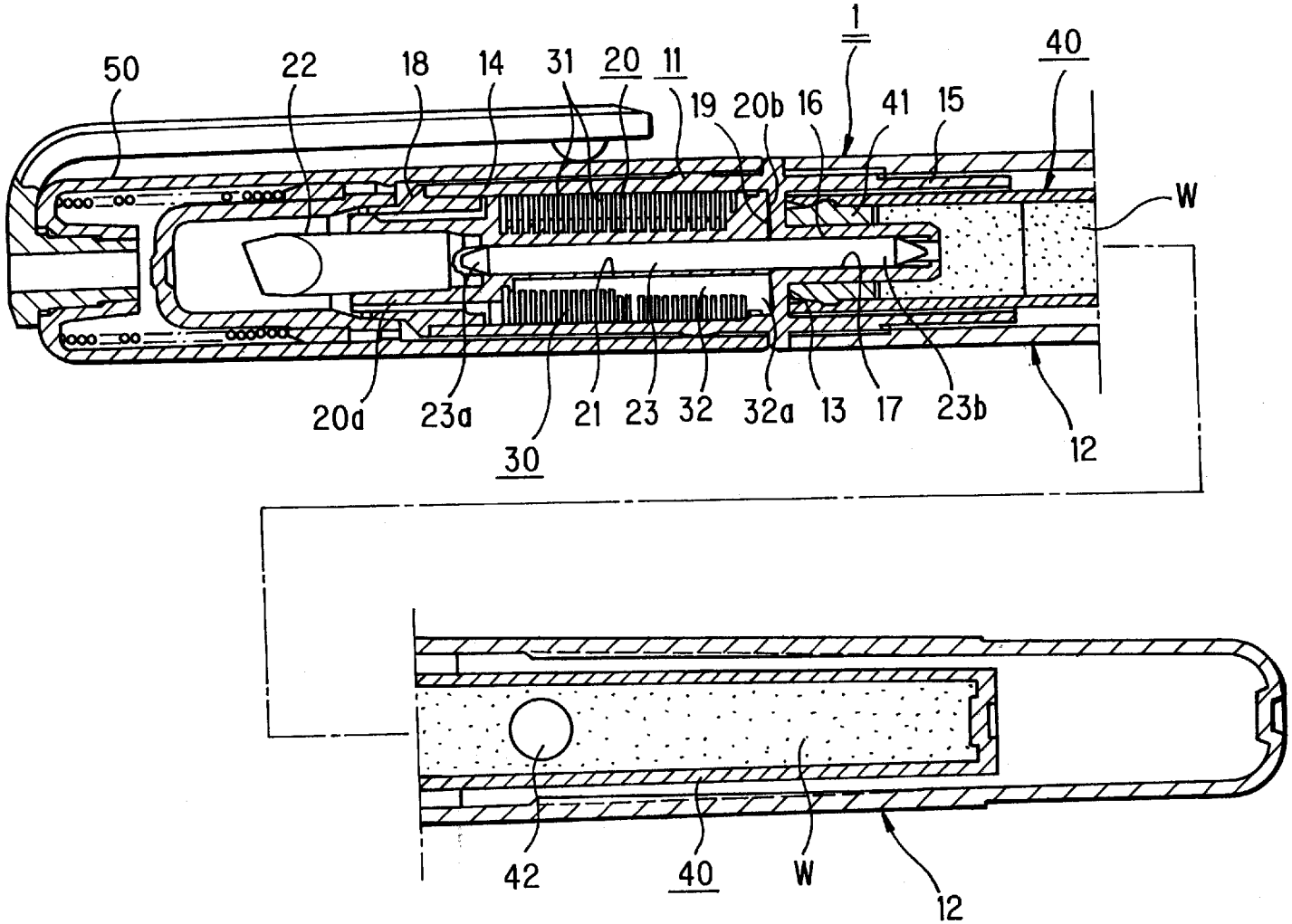
FIG. 2 is a sectional view showing the overall configuration of a felt pen according to one embodiment of the present invention.

FIG. 2 shows the overall configuration of a writing implement such as a marking pen, felt pen, etc., of a cartridge replaceable type in accordance with one embodiment of the present invention.

In the writing implement shown in FIG. 2, designated at 1 is a barrel body. This barrel body 1 is composed of a front barrel (pen tip barrel) 11 having a removable cap 50 fitted thereon and a rear barrel (pen rear barrel) 12 separably screw-fitted to front barrel 11.

Figure 3:
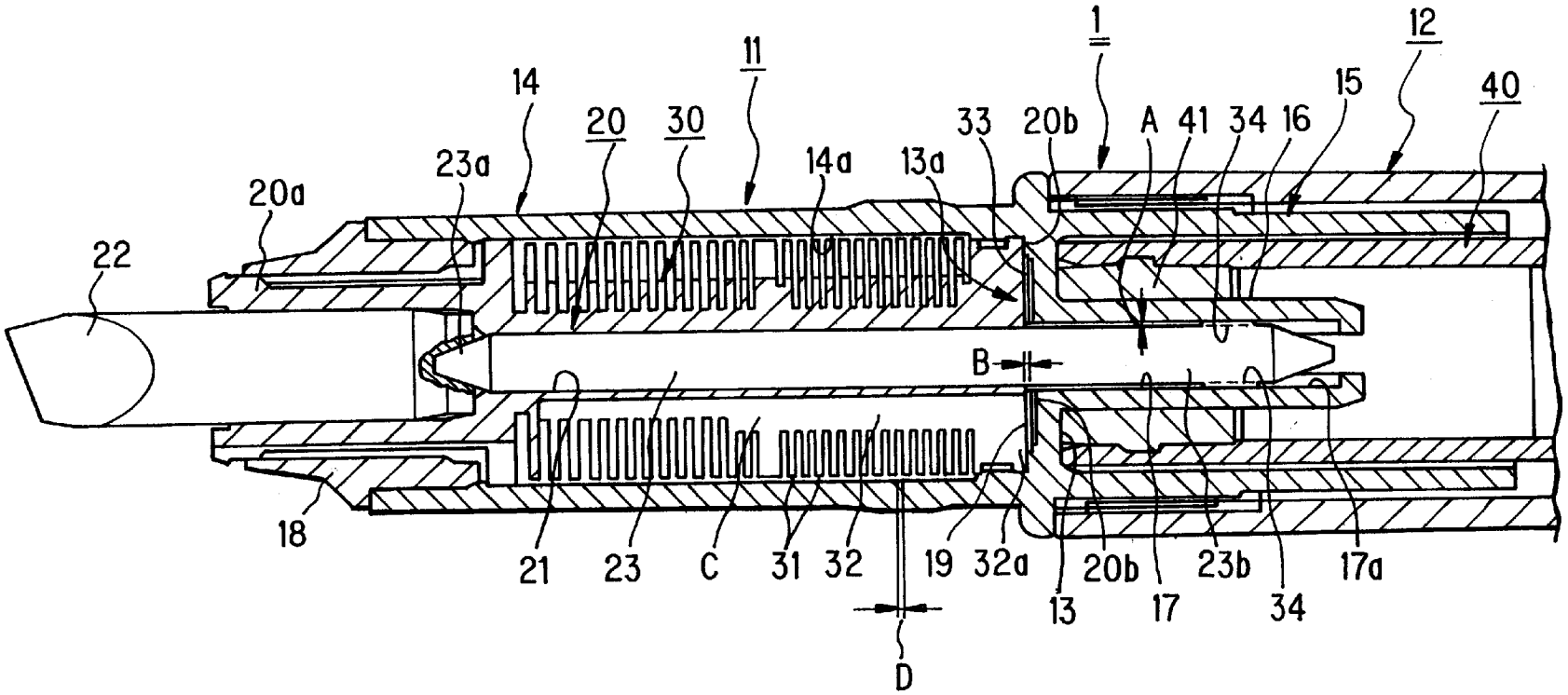
FIG. 3 is a partially enlarged sectional view showing the same configuration with its cap removed.

This front barrel 11 has a partition 13 which sections the front barrel into a front sleeve 14 and a rear sleeve 15, as shown in FIG. 3. The partition 13's wall surface on the front sleeve 14 side inside front barrel 11 is formed with a stepped, concave portion 19, depressed in its center with respect to the peripheral part thereof.

A cylindrical projection 16 is formed in rear sleeve 15 concentrically on its axis. A replaceable cartridge 40 holding ink W (also called raw ink) containing pigments, etc., is removably attached so that its front end is fitted to this cylindrical projection 16. That is, the front end opening of cartridge 40 is tightly sealed by a sealing ball 42 in cooperation with a sealing ball seat 41 and when the tight sealing of sealing ball 42 is released, ink W inside cartridge 40 is introduced to a communication passage 17 of cylindrical projection 16.

Provided at the front end of front sleeve 14 of front barrel 11 is a sealing sleeve 18, by which a collector 20 is inserted into front sleeve 14. This collector 20 is retained loosely with respect to an inner peripheral surface 14*a* of front sleeve 14 so as to allow air communication with the atmosphere. Formed in the central shaft of this collector is a communication passage 21 that opposes and is in communication with communication passage 17 of cylindrical projection 16. A plastic mouthpiece 20*a* forming the front part of collector 20 has a pen core 22 inserted therein and held at the front end portion of communication passage 21. This pen core 22 is joined to a front end portion 23*a* of trunk core 23 inserted in communication passage 21.

Further, the rear end face, designated at 20*b*, of collector 20 is abutted on concave portion 19 of partition 13 in front barrel 11 so as to create a gap B (corresponding to the first gap) between rear end face 20*b* and concave portion 19. This gap B and the width C of ink slit (liquid conduit slit) 32 are communicated to each other.

At the same time, trunk core 23 is tightly inserted in communication passage 21 while its rear end 23*b* is loosely fitted to communication passage 17 of cylindrical projection 16 formed on the rear sleeve 15 side of front barrel 11 so as to create a gap (corresponding the second gap) A with respect to the inner periphery of communication passage 17. With this arrangement, ink W stored in cartridge 40 is introduced to the communication passage 21 side of collector 20 via communication passage 17 of cylindrical projection 16 and permeates trunk core 23 to be supplied to the pen core 22.

Formed further on the outer peripheral portion of collector 20 is an ink collecting portion 30, which is composed of a multiple number of collector vanes 31 arranged comb-like in the axial direction with intervals of a desired spacing D. An ink slit 32 allowed to communicate with the atmosphere is formed extending in the axial direction across all collector vanes 31. The open end, designated at 32*a* of this ink slit 32, on the collector rear end face 20*b* side, is adapted to communicate with gap A between the inner peripheral surface of cylindrical projection 16 and trunk core 23 by way of gap B.

That is, this gap B establishes communication between ink slit 32 having a width of C formed in the outer peripheral portion of collector 20 and gap A between the inner periphery of cylindrical projection 16 and trunk core 23, so as to be able to temporarily retain excessive ink W overflowing with variation in pressure inside cartridge 40 due to temperature rise from, for example, body temperature of the hand holding barrel body 1 during writing, thus preventing ink W from overflowing from the front end side of front sleeve 14.

Figure 4:
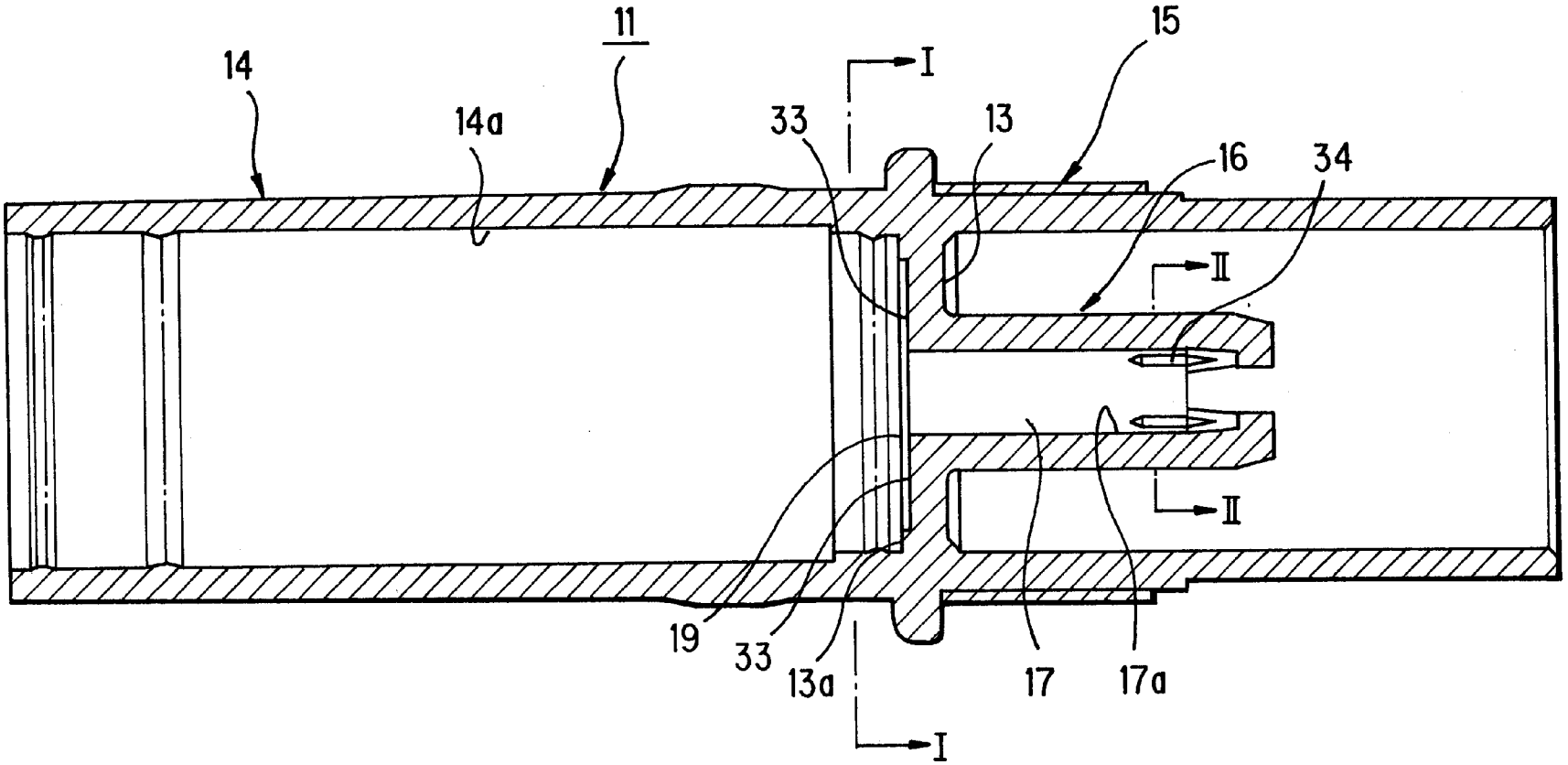
FIG. 4 is an enlarged sectional view showing the front barrel of the same configuration.
Figure 5:
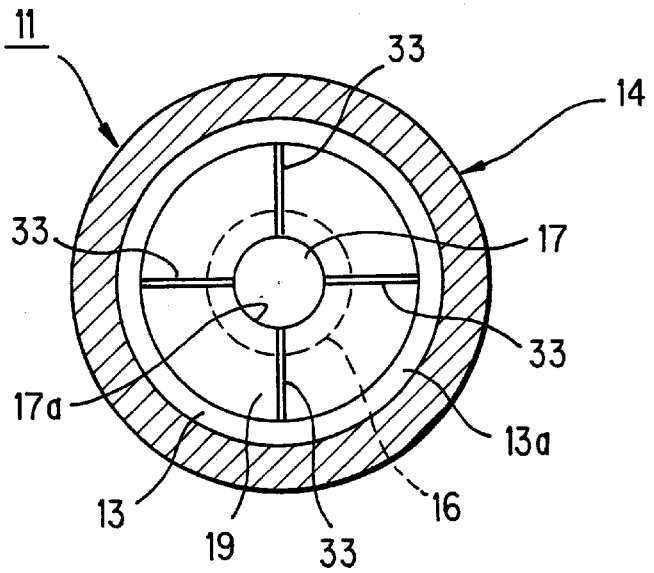
FIG. 5 is a sectional view showing a partition in the front barrel, cut along plane I—I and viewed in the direction of the arrow in FIG. 4.
Figure 6:
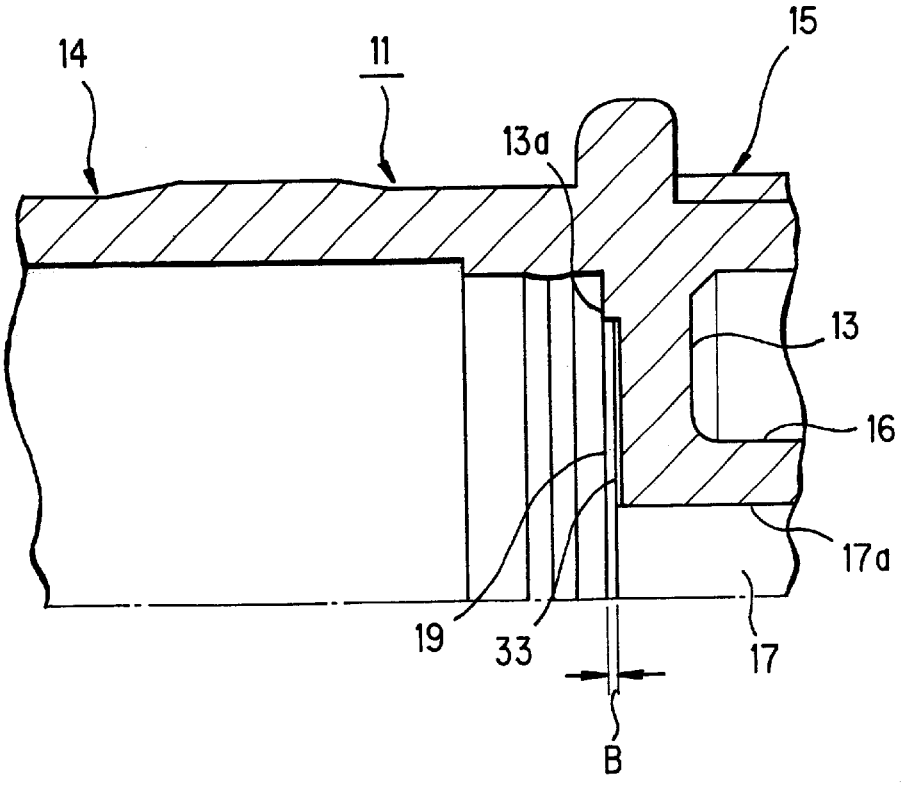
FIG. 6 is a partially enlarged sectional view showing the area around the partition in the same front barrel.

As shown in FIGS. 4 through 6, the abutment face, designated at 13*a*, of partition 13 inside front barrel 11, against which rear end face 20*b* of collector 20 abuts, is formed with stepped, concave portion 19. That is, open end 32*a* of ink slit 32 is formed corresponding to gap B created between the abutment face 13*a* of partition 13 and rear end face 20*b* of collector 20 by the presence of concave portion 19, thus establishing communication of ink slit 32 with gap A between the inner periphery of cylindrical projection 16 and trunk core 23. Here, stepped, concave portion 19 formed in abutment face 13*a* of partition 13 inside front barrel 11 is formed with a plurality of grooves 33 extending radially outwardly with respect to the axial center. Each groove 33 is formed so as to be equal in either width or depth to the step size of gap B.

Figure 7:
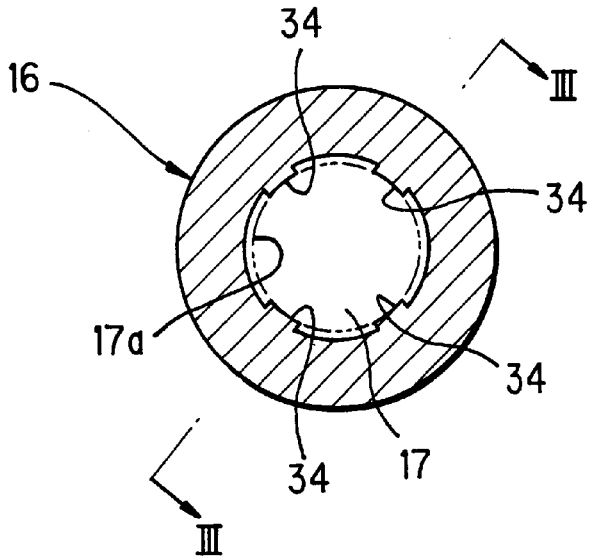
FIG. 7 is a partially enlarged sectional view showing a cylindrical projection, cut along plane II—II and viewed in the direction of the arrow in FIG. 4.
Figure 8:
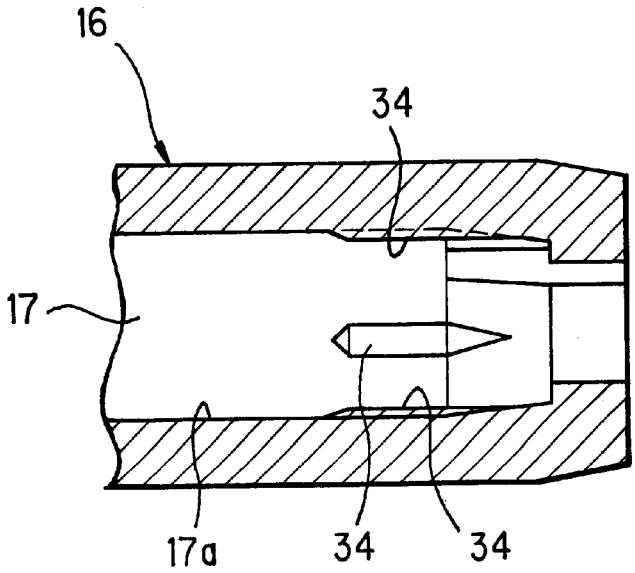
FIG. 8 is a partially sectional view showing the cylindrical projection, cut along plane III—III and viewed in the direction of the arrow in FIG. 7.

As stated above, rear end 23*b* of trunk core 23 is inserted into communication passage 17 in cylindrical projection 16 on the rear sleeve 15 side of front barrel 11. As shown in FIGS. 7 and 8, a plurality of ribs 34 are formed apart with respect to the barrel's circumference on inner peripheral surface 17*a* of this communication passage 17. These ribs 34 support rear end 23*b* of trunk core 23 keeping it at a distance from inner peripheral surface 17*a* of communication passage 17 in cylindrical projection 16 to create gap A.

According to the present invention thus configured, since the stepped, concave portion formed in the partition inside the front barrel is formed with a plurality of grooves extending radially outwardly with respect to the axial center, it is possible to secure adequate liquid channels to the liquid conduit slit even if the gap to be formed between the collector's rear end face and the abutment face of the partition becomes narrower or blocked due to elongation or sink caused by contraction during resin molding of the front barrel. This configuration allows the liquid to flow easily by the capillary action of the conduit slit, thus providing stable ink supply performance.

According to the present invention thus configured, since either the width or the depth of the aforementioned grooves is set equal to the gap or the size of the step formed in the stepped, concave portion, it is possible to secure adequate ink channels to the ink slit even if the gap to be formed between the collector's rear end face and the abutment face of the partition becomes narrower or blocked. This configuration allows the ink to flow easily by the capillary action of the ink slit, thus providing stable ink supply performance.

Since a plurality of ribs are formed apart with respect to the barrel's circumference on the inner peripheral surface of the communication passage in the cylindrical projection on the rear sleeve side of the front barrel, to which the rear end of the trunk core is inserted so as to support the rear end of the trunk core by creating a gap from the inner peripheral surface of the communication passage of the cylindrical projection, it is thus possible to enhance the precision of the gap in all directions between the outer periphery of the trunk core and the wall defining the communication passage in the cylindrical projection.

In the present invention, gap A between the surface of rear end 23*b* of trunk core 23 and inner peripheral surface 17*a* of communication passage 17 in cylindrical projection 16 may be set so that $0.02\ \text{mm} \leqq A \leqq 0.25\ \text{mm}$.

Further, the ink to be used should be of a water-based ink having a viscosity of 12 mPa.s or below at 25° C.

With the writing implement of this embodiment, the ink to be used is stored in cartridge 40. Diverse examples of writing implements were evaluated by varying the size of gap A and using ink of different viscosity, and it was found that good results were obtained with water-based ink when the size fell within the above range.

The evaluation test that was carried out will be described next.

First, writing implements with diverse sizes of gap A were evaluated using a water-based ink having a viscosity of 6 mPa.s at 25° C. The test result is shown in Table 1.

TABLE 1

| Gap A (mm) | 0.01 | 0.02 | 0.05 | 0.20 | 0.25 | 0.30 |
|---|---|---|---|---|---|---|
| Ink starvation during writing | C | A | AA | AA | AA | AA |
| Forward leakage | A | A | A | A | A | C |

*Ink starvation means the degree to which the user will have a bad sensation from nonuniformity or defectiveness of the line drawing of the ink in the actual drawing test. In the table, AA: excellent; A: Good; B: slight ink starving; and C : obvious ink starving.
*Concerning the forward leakage, A : no forward leakage; and C : occurrence of forward leakage.

As is understood from the test result, it was found that gap A of 0.02 mm or greater is effective in eliminating the ink starvation during writing. Concerning the forward leakage of ink, it was found that no forward leakage occurs when gap A is 0.25 mm or below. From these facts, it is appropriate that gap A should be set within the range of 0.02 mm to 0.25 mm (0.02 mm≦A≦0.25 mm). Additionally, it is more preferable that gap A should be set within the range of 0.05 mm to 0.25 mm (0.05 mm≦A≦0.25 mm) because of the fact that 'evaluation on ink starvation during writing' was excellent in this range.

If the ink viscosity becomes greater, the ink flow becomes poor since the ink is supplied to the pen core by the capillary attraction of the ink to the trunk core, and hence ink starvation during writing becomes liable to occur. Therefore, the dependence of ink starvation upon the ink viscosity was checked with a small gap A, and the result is shown in Table 2.

TABLE 2

| Ink viscosity (mPa·s/25° C.) | 1 | 6 | 12 | 15 |
|---|---|---|---|---|
| Ink starvation during writing | AA | AA | A | B |

From this result, it was confirmed that no problem concerning ink starvation during writing will occur if ink has a viscosity of 12 mPa.s or below at 25° C.

From the above, it is understood that it is possible to design a writing implement presenting good writing performance by specifying gap A within the range of 0.02 mm to 0.25 mm (0.02 mm≦A≦0.25 mm).

In the present invention, it is also possible to specify the second gap (A), the first gap (B), the slit width (C) and the spacing (D) so as to hold the following relationship:

$$A \leqq B \leqq C \leqq D.$$

Setting of the dimensions of gap A, gap B, slit width C and collector vane spacing D so as to hold the relationship A≦B≦C≦D assures smooth flow and return of the application liquid such as ink with respect to the cartridge.

Actually, the spacing becomes greater in the order of second gap A, first gap B, slit width C and collector vane spacing D, capillary attraction naturally becomes smaller in the same order. Therefore, with a temperature rise or with a reduction in atmospheric pressure, ink W inside cartridge 40 is pushed out, and the ink fills second gap A, first gap B, slit width C and collector vane spacing D, in this order, thus inhibiting ink W from leaking from the tip of pen core 22. Conversely, with a temperature drop, with an increase in atmospheric pressure, or upon writing, ink W returns into cartridge 40 from these spacings. In this case, ink returns or empties in the order of collector vane spacing D, slit width C, first gap B and second gap A. In particular, ink will never be left behind in spacing D between collector vanes 31.

If the above the relationship A≦B≦C≦D does not hold, the application liquid will not flow in and out smoothly, and when the application liquid in cartridge 40 is pushed out, the liquid will not enter the spacings in the desired order and creates an air layer, at which the retaining force of the application liquid becomes greater, making ink W liable to leak from pencore 22. Also when ink W returns to cartridge 40, the ink does not return correctly, instead air enters, also resulting in failures to retain ink. In contrast, the writing implement of the present embodiment is free from the above drawbacks and can draw upon all of the collector's function.

In the above embodiment, spacing D between adjacent collector vanes may not be constant, and preferably becomes greater toward pen core 22. In this case, the smallest spacing D may and should satisfy the relationship A≦B≦C≦D.

In the above embodiment, description was made with reference to an example of a writing implement such as a felt pen or the like, but the present invention should not be limited to this and can be applied to applicators for cosmetics such as eyebrow and other applicators. Various modifications can be added to the present invention without departing from the sprint and scope of the present invention.

As has been apparent from the above description, in accordance with the present invention, the abutment face of the partition inside the front barrel, which the rear end face of the collector abuts, is formed with a stepped, concave portion, so as to create the first gap between the abutment face of the partition and the rear end face of the collector, thus establishing communication between the second gap between the inner periphery of the cylindrical projection and the trunk core and the conduit slit formed in the axial direction across the collector vanes for retaining the applicator liquid. Therefore, the application liquid inside cartridge can be temporarily retained between the collector vanes in an assured manner.

Since second gap A is specified so that 0.02 mm≦A≦0.25 mm and the ink is specified so as to have a viscosity of 12 mPa.s or below at 25° C., it is possible to smoothly replace the ink or liquid inside the cartridge with air as the liquid is being applied and the pressure inside the cartridge becomes lowered. Therefore, the reduced pressure inside the cartridge can be cancelled smoothly. Accordingly, this feature contributes to elimination of writing or application failures such as liquid starvation during line drawing. Further, even with a water-based application liquid having a low viscosity, the setting of the second gap as above prevents forward leakage of the liquid, presenting a good result.

Further, according to the present invention, it is possible to lead ink or application liquid for cosmetics, etc., from the cartridge to the conduit slit at the collector's rear end in a stable manner, enabling smooth flowing of the application liquid between the cartridge and the collector.

In accordance with the liquid applicator of the present invention thus configured as above, the abutment face of the partition inside the front barrel, which the rear end face of the collector abuts, is formed with a stepped, concave portion, so as to create the first gap between the abutment face of the partition and the rear end face of the collector, thus establishing communication between the second gap between the inner periphery of the cylindrical projection and the trunk core and the conduit slit formed in the axial direction across the collector vanes for retaining the applicator liquid. Therefore, the application liquid inside cartridge can be temporarily retained between the collector vanes in an assured manner.

Further, since the second gap (A), the first gap (B), the slit width (C) and the spacing (D) between the collector's vanes are specified so as to hold the following relationship: A≦B≦C≦D, this assures smooth flow and return of the application liquid such as ink with respect to the cartridge. Actually, the spacing becomes greater in the order of the second gap (A), the first gap (B), the slit width (C) and the collector vane spacing (D), capillary attraction naturally becomes smaller in the same order. Therefore, with a temperature rise or with a reduction in atmospheric pressure, the application liquid inside the cartridge is pushed out, and the application liquid fills the second gap (A), the first gap (B), the slit width (C) and collector vane spacing (D), in this order, thus inhibiting the application liquid from leaking from the tip of the application element. Conversely, with a temperature drop, with an increase in atmospheric pressure, or upon writing, the application liquid returns into the cartridge from these spacings. In this case, the application liquid returns or empties in the order of the collector vane spacing (D), the slit width (C), the first gap (B) and the second gap (A). In particular, the application liquid will never be left behind in the collector vane spacing (D).

If the above the relationship A≦B≦C≦D does not hold, the application liquid will not flow in and out smoothly, and when the application liquid in the cartridge is pushed out, the liquid will not enter the spacings in the desired order and creates an air layer, at which the retaining force of the application liquid becomes greater, making the application liquid liable to leak from the pen core. Also when the application liquid returns to the cartridge, the application liquid does not return correctly, instead air enters, also resulting in failures to retain the application liquid again. In contrast, the writing implement of the present invention is free from the above problems.

In conclusion, according to the present invention, it is possible to provide excellent application performance or writing performance free from the drawback of ink starvation during writing due to insufficient supply of ink during line drawing and the drawback of forward leakage of the liquid, thus providing stable supplying performance of the application liquid.

What is claimed is:

1. A liquid applicator for applying an application liquid comprising:

a barrel body composed of a front barrel and a rear barrel separably fitted to the front barrel, the front barrel having a partition therein which sections the front barrel into a front sleeve and a rear sleeve, the partition having a surface on the front sleeve side of the partition which is formed with a stepped concave portion depressed in its center with respect to an outer peripheral part thereof;

a trunk core for allowing the application liquid to permeate therethrough and be supplied to a pen core;

a collector having a central shaft forming a communication passage is disposed in the front barrel, the collector having a front end in which the pen core is inserted, the trunk core being disposed in the passage, the pen core being joined to a front end portion of the trunk core, the central shaft being continuous from a rear end of the pen core and having a communication passage for holding the front end portion of the trunk core, and a plurality of collector vanes arranged on an outer periphery of the collector and spaced at intervals in an axial direction for temporarily retaining the application liquid within the spacing, the collector being inserted inside the front sleeve in a manner that allows an outer peripheral portion to communicate with the atmosphere, wherein a liquid conduit slit is formed in the collector such that the slit extends between the central shaft and internal edges of the collector vanes, and a rear end of the collector is abutted against the stepped concave portion so as to define a first gap with respect to the center of the stepped concave portion while the first gap and the liquid conduit slit are communicated with each other;

a cylindrical projection extends from the partition into the rear sleeve and defines a communication passage into which a rear end of the trunk core extends, the trunk core being spaced from an inner wall of the projection so as to define a second gap; and a replaceable cartridge for storing the application liquid being removably mounted to the cylindrical projection, wherein the application liquid inside the cartridge is supplied to the pen core by way of the trunk core while the application liquid is also temporarily retained in the spacing between the collector vanes by virtue of the second gap being in fluid communication with the first gap and the liquid conduit slit; and the stepped concave portion on the partition is formed with a plurality of grooves extending radially outwardly from an axial center.

2. The liquid applicator according to claim 1, wherein each groove is formed so as to be equal in either width or depth to a size of the first gap.

3. The liquid applicator according to claim 2, wherein a plurality of ribs are formed on an inner peripheral surface of the communication passage, into which the trunk core is inserted, inside the cylindrical projection in the rear sleeve of the front barrel, so that the ribs support the rear end of the trunk core keeping it at a desired distance from the inner peripheral surface of the communication passage of the cylindrical projection.

4. The liquid applicator according to claim 1, wherein a plurality of ribs are formed on an inner peripheral surface of the communication passage, into which the trunk core is inserted, inside the cylindrical projection in the rear sleeve of the front barrel, so that the ribs support the rear end of the trunk core keeping it at a desired distance from the inner peripheral surface of the communication passage of the cylindrical projection.

5. A liquid applicator for applying an application liquid comprising:

a barrel body composed of a front barrel and a rear barrel separably fitted to the front barrel, the front barrel having a partition therein which sections the front barrel into a front sleeve and a rear sleeve, the partition having a surface on the front sleeve side of the partition which is formed with a stepped concave portion depressed in its center with respect to an outer peripheral part thereof;

a trunk core for allowing the application liquid to permeate therethrough and be supplied to a pen core;

a collector having a central shaft forming a communication passage is disposed in the front barrel, the collector having a front end in which the pen core is inserted, the trunk core being disposed in the passage, the pen core being joined to a front end portion of the trunk core, and a plurality of collector vanes arranged on an outer periphery of the collector and spaced at intervals of spacing (D) in an axial direction for temporarily retaining the application liquid within the spacing, the collector being inserted inside the front sleeve in a manner that allows an outer peripheral portion to communicate with the atmosphere, wherein a liquid conduit slit having a predetermined width (C) is formed in the collector such that the slit extends between the central shaft and internal edges of the collector vanes, and a rear end of the collector is abutted against the stepped concave portion so as to define a first gap (B) with respect to the center of the stepped concave portion while the first gap and the liquid conduit slit are communicated with each other and the trunk core is not in direct communication with the liquid conduit slit;

a cylindrical projection extends from the partition into the rear sleeve and defines a communication passage, wherein a rear end of the trunk core extending from the collector's communication passage is inserted into the communication passage of the cylindrical projection, the trunk core being spaced from an inner wall of the projection so as to define a second gap (A); and a replaceable cartridge for storing the application liquid being removably mounted to the cylindrical projection, wherein the application liquid inside the cartridge is supplied to the pen core by way of the trunk core while the application liquid is also temporarily retained in the spacing between the collector vanes by virtue of the second gap being in fluid communication with the first gap and the liquid conduit slit; and the second gap (A) is specified to fall within the following range:

$$0.02\ \text{mm} \leqq A \leqq 0.25\ \text{mm},$$

and the application liquid is a water-based liquid having a viscosity of 12 mPa.s or below at 25° C.

6. A liquid applicator for applying an application liquid comprising:

a barrel body composed of a front barrel and a rear barrel separably fitted to the front barrel, the front barrel having a partition therein which sections the front barrel into a front sleeve and a rear sleeve, the partition having a surface on the front sleeve side of the partition which is formed with a stepped concave portion depressed in its center with respect to an outer peripheral part thereof;

a trunk core for allowing the application liquid to permeate therethrough and be supplied to a pen core;

a collector having a central shaft forming a communication passage is disposed in the front barrel, the collector having a front end in which the pen core is inserted, the trunk core being disposed in the passage, the pen core being joined to a front end portion of the trunk core, and a plurality of collector vanes arranged on an outer periphery of the collector and spaced at intervals of spacing (D) in an axial direction for temporarily retaining the application liquid within the spacing, the collector being inserted inside the front sleeve in a manner that allows an outer peripheral portion to communicate with the atmosphere, wherein a liquid conduit slit having a predetermined width (C) is formed in the collector such that the slit extends between the central shaft and internal edges of the collector vanes, and a rear end of the collector is abutted against the stepped concave portion so as to define a first gap (B) with respect to the center of the stepped concave portion while the first gap and the liquid conduit slit are communicated with each other and the trunk core is not in direct communication with the liquid conduit slit;

a cylindrical projection extends from the partition into the rear sleeve and defines a communication passage, wherein a rear end of the trunk core extending from the collector's communication passage is inserted into the communication passage of the cylindrical projection, the trunk core being spaced from an inner wall of the projection so as to define a second gap (A); and a replaceable cartridge for storing the application liquid being removably mounted to the cylindrical projection, wherein the application liquid inside the cartridge is supplied to the pen coreby way of the trunk core while the application liquid is also temporarily retained in the spacing between the collector vanes by virtue of the second gap being in fluid communication with the first gap and the liquid conduit slit; and the second gap (A), the first gap (B), the slit width (C) and spacing (D) are specified so as to satisfy the following relation:

$$A \leqq B \leqq C \leqq D.$$

* * * * *